US005707268A

United States Patent [19]

Outman

[11] Patent Number: 5,707,268

[45] Date of Patent: Jan. 13, 1998

[54] GEOMETRIC CONSTRUCTION TOY SET

[76] Inventor: Karl S. Outman, 6F Adrian Ct., Peekskill, N.Y. 10566

[21] Appl. No.: 615,735

[22] Filed: Mar. 14, 1996

[51] Int. Cl.[6] ..... A63H 33/04

[52] U.S. Cl. ..... 446/112; 446/104; 446/115; 446/122

[58] Field of Search ..... 446/85, 112, 102, 446/104, 108, 111, 114, 115, 116, 119, 122, 124, 125, 127

[56] References Cited

U.S. PATENT DOCUMENTS

| | | | |
|---|---|---|---|
| 1,883,214 | 10/1932 | Wilson et al. | 446/113 |
| 2,446,120 | 7/1948 | Wiswesser | 446/115 |
| 2,509,669 | 5/1950 | Borst | 446/122 |
| 3,066,436 | 12/1962 | Schuh | 446/115 |
| 3,271,895 | 9/1966 | Sorensen | 446/122 |
| 3,537,706 | 11/1970 | Heavener | 446/85 |
| 3,564,758 | 2/1971 | Willis | 446/114 |
| 4,065,220 | 12/1977 | Ruga | 446/114 |
| 4,666,163 | 5/1987 | Hirschfeld | 446/108 |

FOREIGN PATENT DOCUMENTS

| | | | |
|---|---|---|---|
| 486018 | 5/1938 | United Kingdom | 446/124 |

*Primary Examiner*—Robert A. Hafer
*Assistant Examiner*—Jeffrey D. Carlson
*Attorney, Agent, or Firm*—Michael Ebert

[57] ABSTRACT

A geometric construction toy set composed of triangular modules having different geometrical forms and sizes, the modules being interlinkable to create a planar mosaic that is transformable by a player into three-dimensional abstract or figurative structures. Each module is constituted by a triangular plate having slotted edges that define three side tines, each extending from a respective vertex. Interhinging of adjacent modules is effected by a coupling sleeve fitting over abutting tines of the modules whereby the modules can then be angled with respect to each other. Two adjacent modules may also be interconnected by intermeshing the abutting side tines of these modules.

12 Claims, 6 Drawing Sheets

GEOMETRIC CONSTRUCTION TOY SET

BACKGROUND OF INVENTION

1. Field of Invention

This invention relates generally to construction toy sets, and more particularly to a set composed of triangular modules which can be interconnected to create a planar mosaic that is transformable by a player into three-dimensional abstract or figurative structures whose configuration depends on the imagination of the player.

2. Status of Prior Art

The most elementary form of a construction toy set consists of blocks all having the same cubical dimensions which a pre-school child can stack and assemble to create structures whose form depends on how the blocks are put together by the child.

There are numerous prior art construction sets such as these sold under the trademarks TINKERTOY and LEGO in which the pieces which make up the set can be joined to enable the player to create three-dimensional forms which do not fall apart, yet can be disassembled. These construction toys serve not only to entertian and amuse the player, but because they effectively teach the child basic principles of geometry and construction, the toy performs a useful educational function.

The 1993 Swann U.S. Pat. No. 5,183,432 discloses a geometric toy construction system formed by flat triangular pieces which are interengageable in edge-to-edge relation to form two and three dimensional structures. The edgewise connectors on the pieces make it possible to snap-fit them together and to rotate the pieces about their axis of interconnection. The connectors are formed by connector sets projecting from the edges of the triangular pieces.

The 1987 U.S. Pat. No. 4,682,892 to Gould shows a toy construction set having triangular pieces each of whose edges has a tab connected thereto by a living hinge, the tabs of adjacent pieces being interconnected. In the 1976 U.S. Pat. No. 3,987,580 to Ausnit, a construction toy is disclosed formed by flexible geometric pieces each of which has a plurality of edges, each edge being provided with a resilient interhooking rib and groove fastener that can be pressed into engagement with the fastener on the edge of another piece.

In the toy construction set shown in the 1962 U.S. Pat. No. 3,066,436 to Schuh, the set is composed of flat rectangular units which are slotted so that the units can be interconnected in various ways. The 1978 patent to Daugherty U.S. Pat. No. 4,073,105 discloses a fabrication device in which triangular modules are interconnected, the edges of each module being curled to form a hook which can be coupled to a similar hook formed in the edge of an adjacent module.

In the 1971 Grinbergs U.S. Pat. No. 3,554,382, there is shown a construction system formed by modular square panels having edge slots so that the panel may be interconnected by a coupling collar engaging the slots of abutting panels.

SUMMARY OF INVENTION

In view of the forgoing, the main object of this invention is to provide a geometric construction toy set composed of flat triangular modules which are interconnectable to create a planar mosaic that can be manipulated by a player to erect three-dimensional abstract or figurative structures whose configuration depends on the imagination of the player.

More particularly, an object of this invention is to provide a set of the above type in which each triangular module regardless of its geometric form and size has slotted edges which define three side tine making it possible to interconnect or interhinge adjacent modules.

Among the significant advantages of a set in accordance with the invention over prior art geometric construction toys are the following:

A. The interconnectable triangular modules which make up the set are single, flat pieces molded of synthetic plastic material and therefore can be mass-produced at low cost.

B. The connectors for interhinging the modules in the set are inexpensive tubular plastic sleeves.

C. The triangular modules included in the set, though varying in their geometric forms and sizes are interconnectable to form a planar mosaic which lends itself to manipulation by a player so that the modules are angled with respect to each other to create three-dimensional structures.

D. There is no real limit to the number of triangular modules which make up the set. Moreover, the greater the number, the more complex the mosaic and the resultant structures which can be created by manipulating the mosaic.

Briefly stated, these objects can be attained by a geometric construction toy set composed of triangular modules having different geometrical forms and sizes, the modules being interlinkable to create a planar mosaic that is transformable by a player into three-dimensional abstract or figurative structures.

Each module is constituted by a triangular plate having slotted edges that define three side tines, each extending from a respective vertex. Interhinging of adjacent modules is effected by a coupling sleeve fitting over abutting tines of the modules whereby the modules can then be angled with respect to each other. Two adjacent modules may be also interconnected by intermeshing the abutting side lines of these modules.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

A geometric construction toy set in accordance with the invention is composed of triangular modules and connectors therefor for interhinging adjacent modules. It is important therefore that the geometrical forms of a Euclidean triangle be understood, for it is these forms which make it possible to interfit a set of triangular modules which differ in their geometrical form and size.

A triangle is a two-dimensional form bounded by three straight sides which meet at three points called vertices. A triangle has three angles, each defined by two sides meeting at a vertex. Regardless of the geometric form of the triangle, its three angles have a sum total of 180 degrees. An equilateral triangle has three equal sides and three 60 degree angles, while a triangle having two equal sides is referred to as an isosceles triangle. But if no two sides are equal, then the triangle is referred to as "scalene."

In a right-angle triangle, one angle is 90 degrees and the other two have a total of 90 degrees, such as 45°+45° or 22.5°+67.5°. Thus while all triangles are three sided and have three-angles, they may differ in their geometric form and sizes.

In a geometric construction toy set in accordance with the invention, the set is composed of triangular modules formed by flat plates having three sides whose edges are slotted to define three side tines. These tines make it possible to interconnect or to interhinge adjacent modules at their abutting sides to create a two-dimensional mosaic formed of a plurality of triangular modules. This mosaic maybe manipulated by a player so as to angle abutting modules with respect to each other and thereby create three-dimensional abstract or figurative structures whose configuration depends on the imagination of the player.

Figure 1:
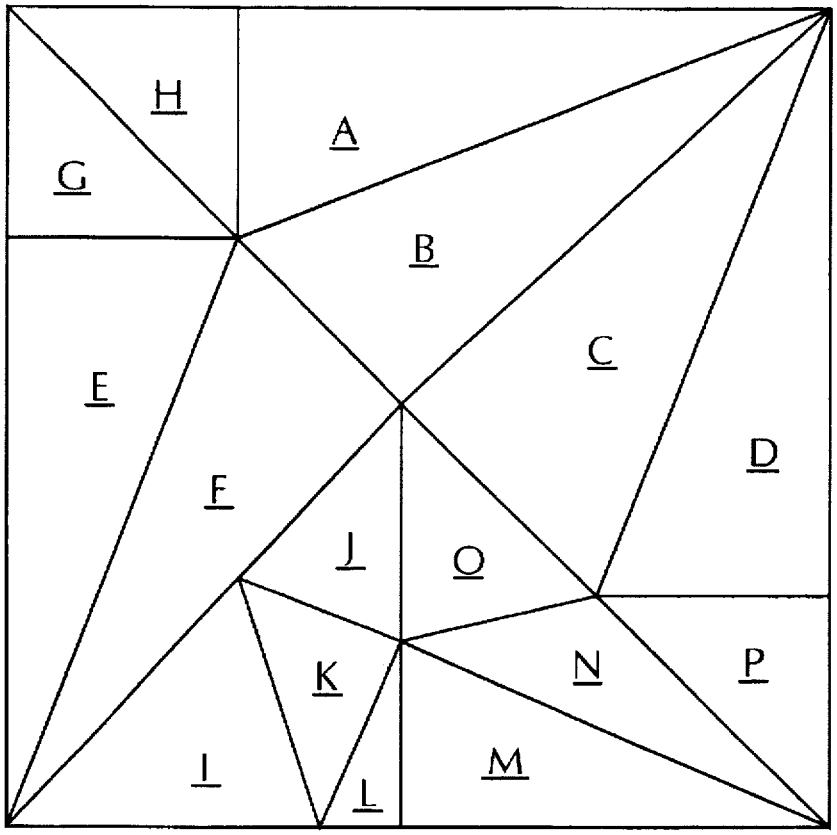
FIG. 1 schematically illustrates a blank composed of interfitting triangular modules included in a geometric toy construction set in accordance with the invention.

Illustrated in FIG. 1 is a planar mosaic formed by interfitting triangular modules A to P which together create a rectangular two-dimensional blank. It will be seen that in this blank, triangular modules A to F have the same size and geometric form, while other modules G to P have different geometric forms and sizes.

Figure 2:
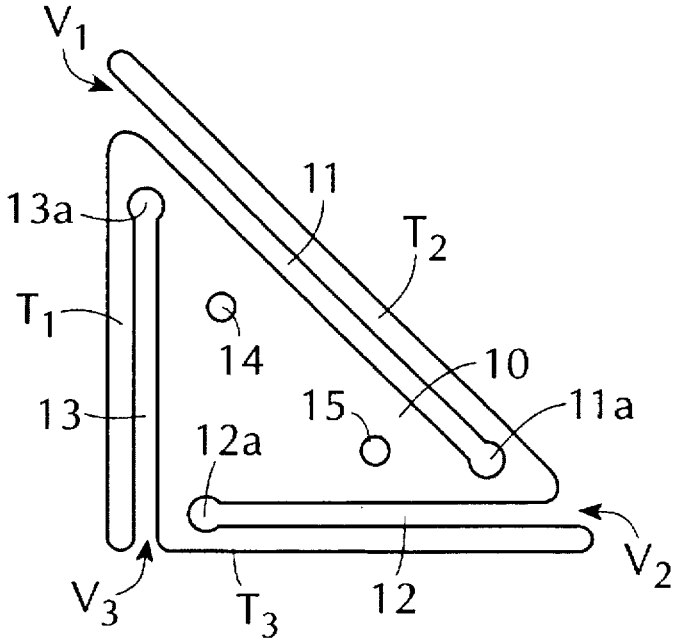
FIG. 2 is a plan view of one of the triangular modules.
Figure 3:
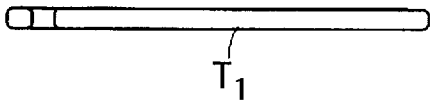
FIG. 3 is a side view of the module shown in FIG. 2.

An example of a three-sided, right-angle triangular module in accordance with the invention is module 10 shown in FIGS. 2 and 3. This module has a 90 degree angle and two 45 degree angles so that it is an isosceles triangle. It is to be understood that the modules which compose the set may have other geometric forms and sizes as long as they are capable of being interfitted with other modules to create a planar mosaic.

Module 10 is preferably molded and die-cut or otherwise fabricated of polyethylene, polypropylene or other high-strength synthetic plastic material to form a thin flexible triangular plate. The three side edges of this plate have elongated slots therein (11, 12 and 13) which are parallel to these edges to define side tines $T_1$, $T_2$ and $T_3$. Tine $T_1$ extends from vertex $V_1$, tine $T_2$ extends from vertex $V_2$ and tine $T_3$ from vertex $V_3$. The end of each slot adjacent its vertex is enlarged by an aperture (11*a*, 12*a* and 13*a*) to provide a hinge point for each tine adjacent its vertex to facilitate flexing of the tine.

The triangular plate of module 10 is provided with a pair of spaced holes 14 and 15 adapted to receive pegs which serve to join together two interhinged modules when these modules are in superposed relation to form a double module.

Figure 4:
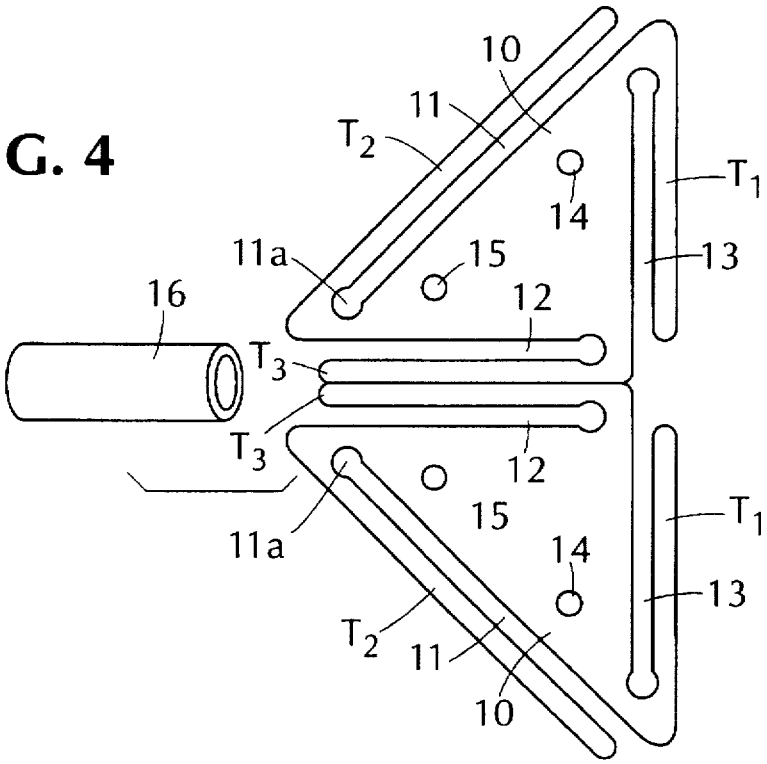
FIG. 4 shows two adjacent modules and a coupling sleeve for interhinging these modules.

The three side tines $T_1$, $T_2$ and $T_3$ on each triangular module make it possible to interhinge adjacent modules having side tines in abutting relation. Thus as shown in FIG. 4, a pair of like right-angle triangular modules 10 which are identical to module 10 in FIG. 2 are placed in opposition with their side tines $T_3$ in abutting relation.

To interhinge this pair of modules, use is made for this purpose of a coupling sleeve 16. This sleeve is formed from a length of extruded synthetic plastic tubing of soft polyethylene or similar material which is collapsed when the tubing is squeezed. The length of coupling sleeve 16 is somewhat shorter than the length of the abutting tines to which it is to be applied. And the internal diameter of sleeve 16 matches the combined widths of the abutting tines.

When therefore sleeve 16 is pushed over the abutting tine $T_3$ of the adjacent modules to occupy the parallel slots 12 thereof, the modules are then interhinged by the sleeve. The interhinged modules which are initially planar, may then be manipulated by a player to assume any desired angle. Because abutting tines $T_3$ are frictionally received in sleeve 16 and are snugly held therein, the resultant hinge is somewhat stiff and acts therefore to maintain the adjusted angle of the adjacent modules.

While FIGS. 2 and 3 illustrate a three-sided triangular module 10 in accordance with the invention, having an isosceles form, it is to be understood that module 10 is by way of example only, and that the modules which compose the set may differ in their triangular geometries and size, as shown in FIG. 1.

Figure 5:
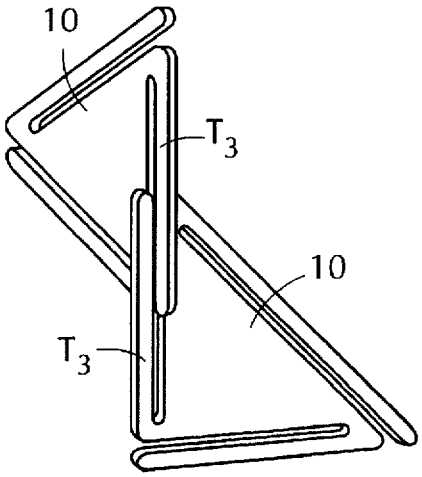
FIG. 5 shows how two modules may be interconnected without the need for a coupling sleeve.
Figure 6:
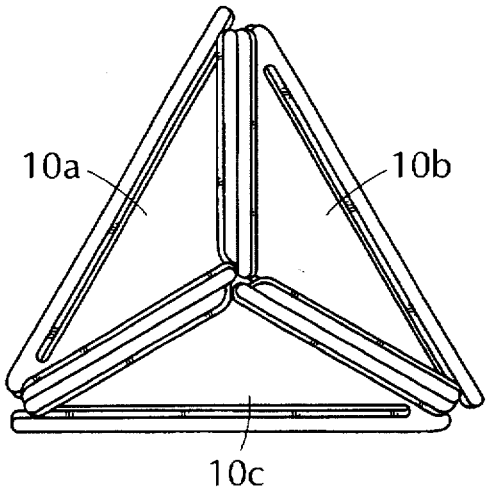
FIG. 6 shows a triangular pyramid created by the modules.

Instead of interhinging adjacent modules 10, they maybe interconnected as shown in FIG. 5 by intermeshing their abutting tines, the tine of each module entering the slot of the adjacent module. By so interconnecting three like modules 10*a*, 10*b* and 10*c*, as shown in FIG. 6, one can create a triangular pyramid.

Figure 7:
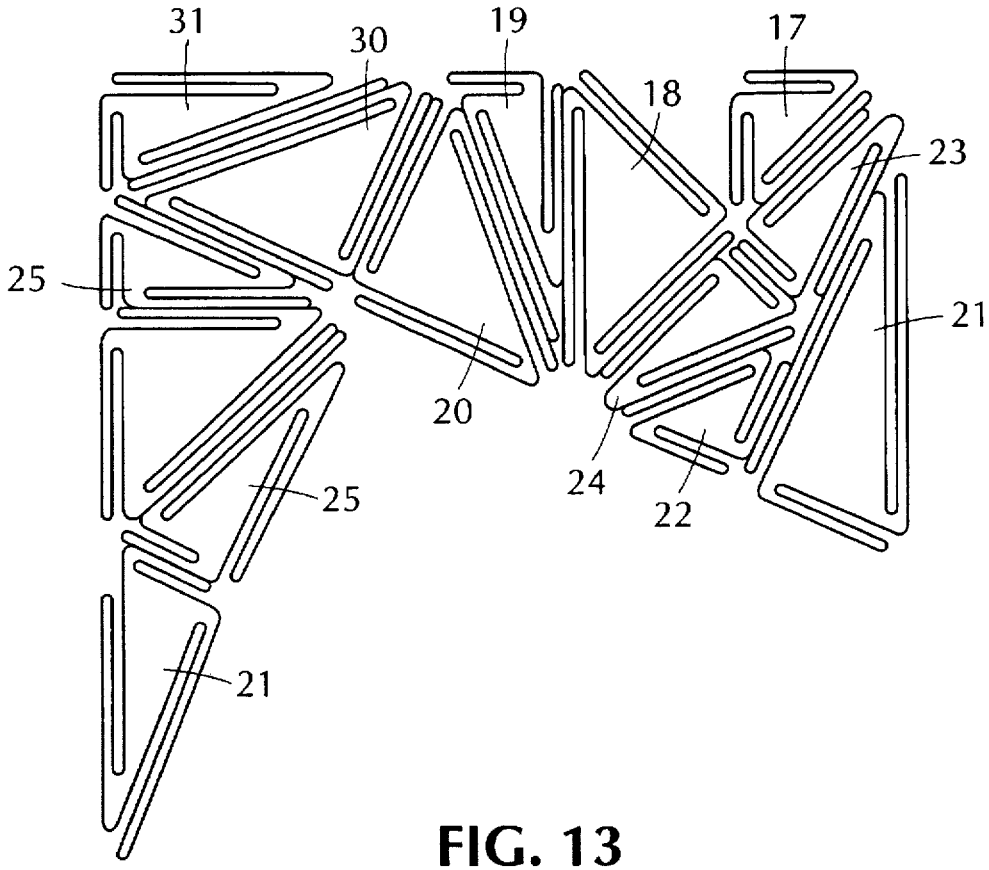
FIG. 7 shows a portion of a planar mosaic formed by a plurality of triangular modules.

FIG. 7 illustrate a portion of a planar mosaic formed by interfitting triangular modules 17 to 31 of different geometric form and size which maybe interhinged by coupling sleeves 16 which fit over the abutting tines of adjacent modules or they may be interconnected by intermeshing these tines.

Figure 8:
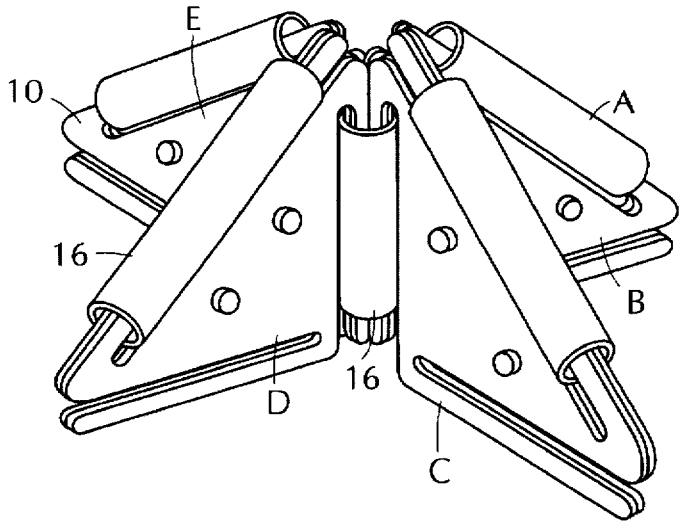
FIG. 8 illustrates a three-dimensional star-shaped structure formed by interhinged modules.
Figure 9:
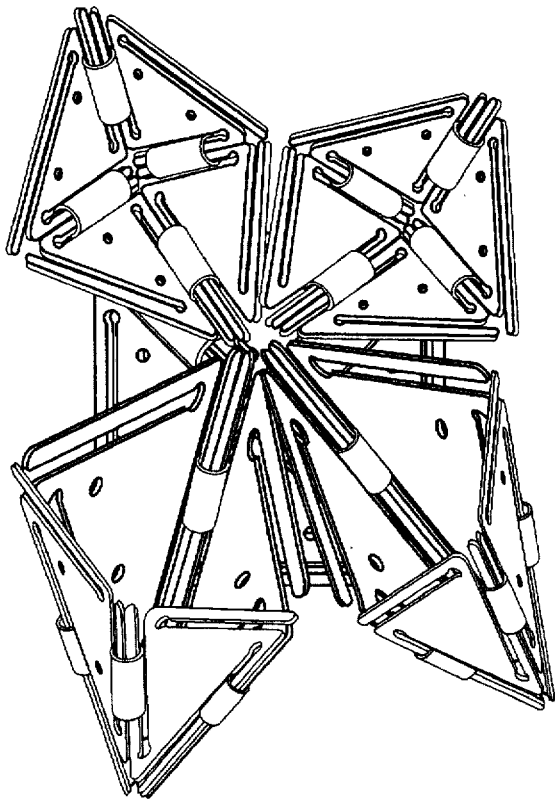
FIG. 9, 10, 11 and 12 illustrate different three-dimensional structures formed from interhinged modules.
Figure 10:
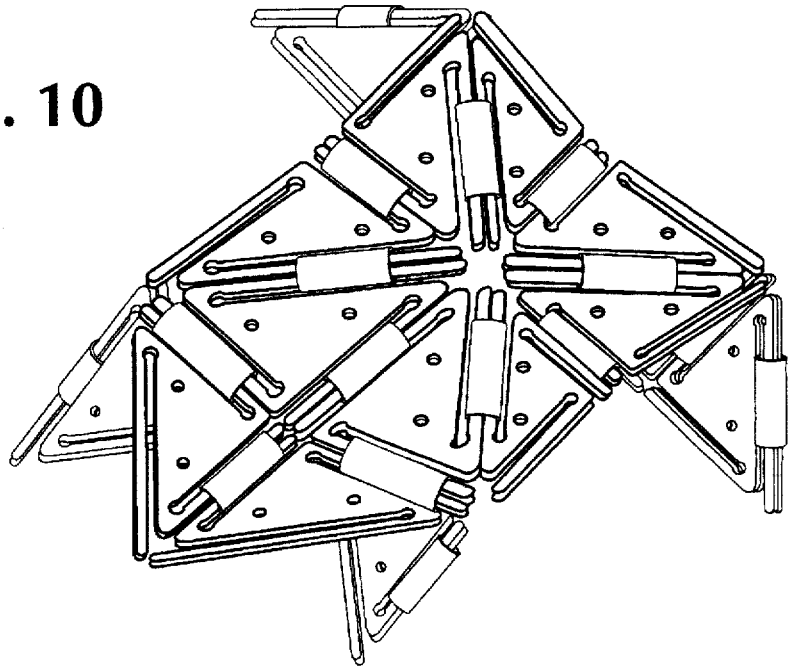
Figure 11:
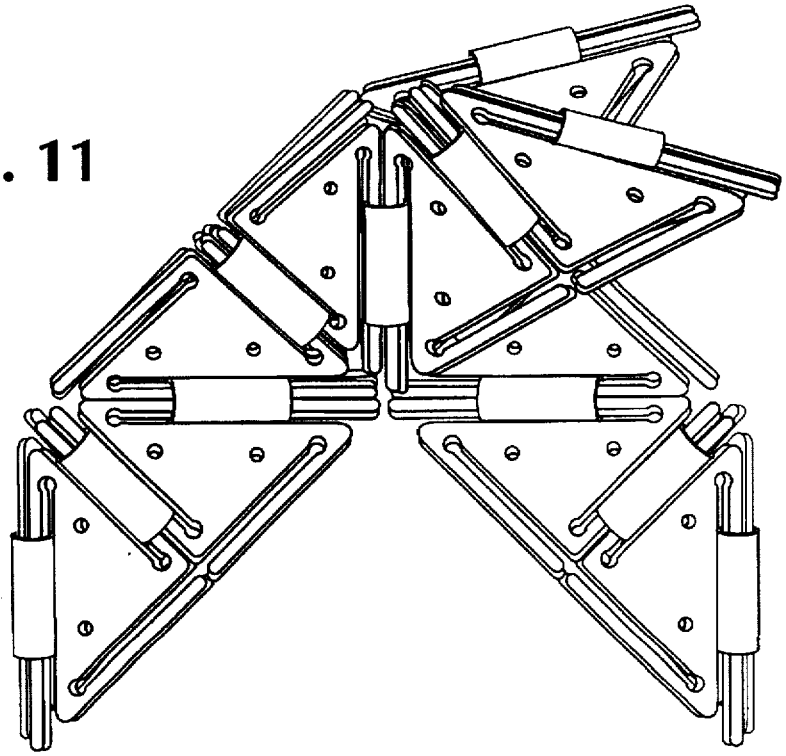
Figure 12:
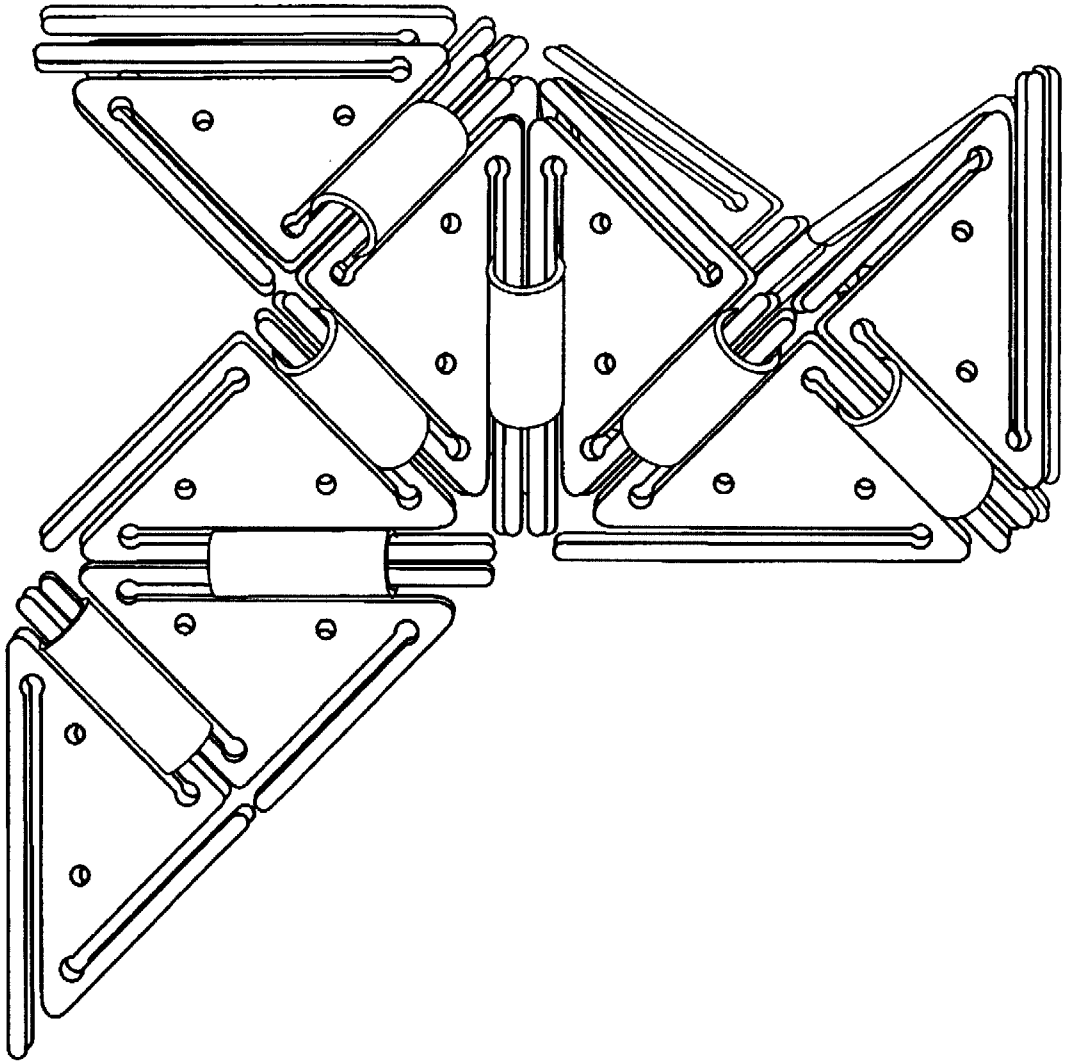

FIG. 8 shows a geometric figure created by interhinging four pairs A, B, C and D of like modules 10. Each pair is formed by superposed twin modules interhinged by coupling sleeves 16. The peg holes included in the modules are used to receive removable pegs to join and rigidify the superposed triangular modules shown in FIG. 8, and their use is therefore optional.

A planar mosaic created by interhinged triangular modules is transformable into three-dimensional abstract or figurative forms that depend on the geometric forms and sizes of the modules which make up the mosaic and on the imagination of the player who manipulates the mosaic. FIGS. 9 to 12 illustrate four of such abstract three-dimensional forms.

Figure 13:
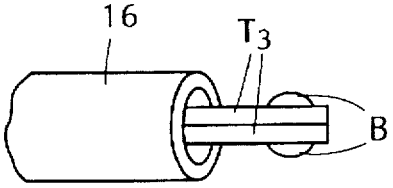
FIG. 13 shows a modified form of side tine included in a triangular module.

In practice, to prevent a coupling collar 16 interhinging abutting tines $T_3$, as shown in FIG. 13 from slipping off the tines, the tines may each be provided adjacent their free end with a detent bump B.

Also in practice, those modules in the set which have the same geometric shape and size may have a distinct color, imparted thereto to distinguish the modules from those having a different geometric shape and size and a different color. By so color coding the modules which compose the set, it makes it easier to interfit modules of different geometric shapes and sizes into a planar mosaic. And it adds to the attractiveness of the structures produced by the modules.

While there has been shown and disclosed preferred embodiments of a geometric construction toy set in accordance with the invention, it will be appreciated that many changes may be made therein without departing from the spirit of the invention.

I claim:

1. A geometric construction set composed of triangular modules which are interlinkable to form a planar mosaic which can be manipulated by a player to transform the mosaic into three-dimensional structures having abstract or figurative forms, each module comprising:

A. a triangular plate having three sides which meet at vertices, each vertex being formed at a point where two of the sides meet;

B. an elongated slot adjacent an outer edge of each side of the plate and parallel thereto, said slot having a length substantially similar to that of the side to define a tine which extends from a respective vertex to a free end whereby when modules in the set are placed adjacent each other, corresponding tines of the modules are then in abutting relation and can therefore be interlinked; and C. an elongated coupling sleeve which fits over the free end of abutting tines and is received within the elongated slots associated therewith to interhinge the adjacent modules which are free to swing.

2. A construction toy as set forth in claim 1, in which the sleeve has an internal diameter which substantially matches the combined widths of the abutting tines.

3. A construction toy as set forth in claim 2, in which the sleeve is formed of a tube of synthetic plastic material which is flexible.

4. A construction toy as set forth in claim 3, in which the sleeve is formed of polyethylene.

5. A construction toy as set forth in claim 1, in which the triangular plate is formed of synthetic plastic material.

6. A construction toy as set forth in claim 1, in which each tine is provided adjacent its free end with a detent bump which when the couling sleeve is fitted over adjacent tines, then prevents the sleeve from falling off the tines.

7. A construction toy as set forth in claim 1, in which the triangular plate is provided with a pair of spaced holes to receive pegs for holding together superposed modules.

8. A construction toy as set forth in claim 1, in which at least one module in the set has an equilateral triangular form.

9. A construction toy as set forth in claim 1, in which at least one module in the set has an isosceles triangular form.

10. A construction toy as set forth in claim 1, in which the slot terminates in a hole to create a hinge point at said vertex.

11. A geometric construction toy as set forth in claim 1, in which the triangular modules which compose the set comprise pluralities of different geometric shapes and sizes.

12. A construction set as set forth in claim 11, in which the modules in the set which have the same geometric shape and size and therefore are like modules have a distinct color imparted thereto to distinguish them from other modules in the set having different geometric shapes, sizes and color.

* * * * *